United States Patent [19]

Groothoff

[11] Patent Number: 4,612,524

[45] Date of Patent: Sep. 16, 1986

[54] DEFLECTION COIL SYSTEM FOR A PICTURE DISPLAY TUBE

[75] Inventor: Adriaan J. Groothoff, Eindhoven, Netherlands

[73] Assignee: U.S. Philips Corporation, New York, N.Y.

[21] Appl. No.: 678,615

[22] Filed: Dec. 6, 1984

[30] Foreign Application Priority Data

Dec. 7, 1983 [NL] Netherlands ..... 8304215

[51] Int. Cl.[4] ..... H01F 7/00

[52] U.S. Cl. ..... 335/210; 335/213

[58] Field of Search ..... 335/210, 212, 213; 324/421, 425

[56] References Cited

U.S. PATENT DOCUMENTS 4,338,584 7/1982 Howard ..... 335/210

FOREIGN PATENT DOCUMENTS 1241917 6/1967 Fed. Rep. of Germany ..... 335/210

1803074 3/1970 Fed. Rep. of Germany ..... 335/210

*Primary Examiner*—George Harris

*Attorney, Agent, or Firm*—William J. Streeter; Leroy Eason

[57] ABSTRACT

The deflection coil system (7) comprises a synthetic resin support (9) which on its outside is surrounded by an annular ferromagnetic core (19) having toroidal deflection coils (21). On the rear portion (11) of the support (9) outwardly directed resilient members (23) which extend approximately perpendicularly to the axis (25) of the support are formed having on their forwardly directed side a face (27) which is inclined with respect to said axis. The faces (27) engage the rear side of the core (19) so that each member (23) on the core on the one hand exerts a radially outwardly directed force (29) centering the core with respect to the axis (25) and on the other hand an axially forwardly directed force (31) urging the core against an abutment (33) on the front of the support (9). Separate components for positioning the core (9) are hence not necessary. If desired the core (19) after assembly may be permanently connected to the support (9) by means of a few drops of adhesive (35).

4 Claims, 4 Drawing Figures

DEFLECTION COIL SYSTEM FOR A PICTURE DISPLAY TUBE

Figure 1:
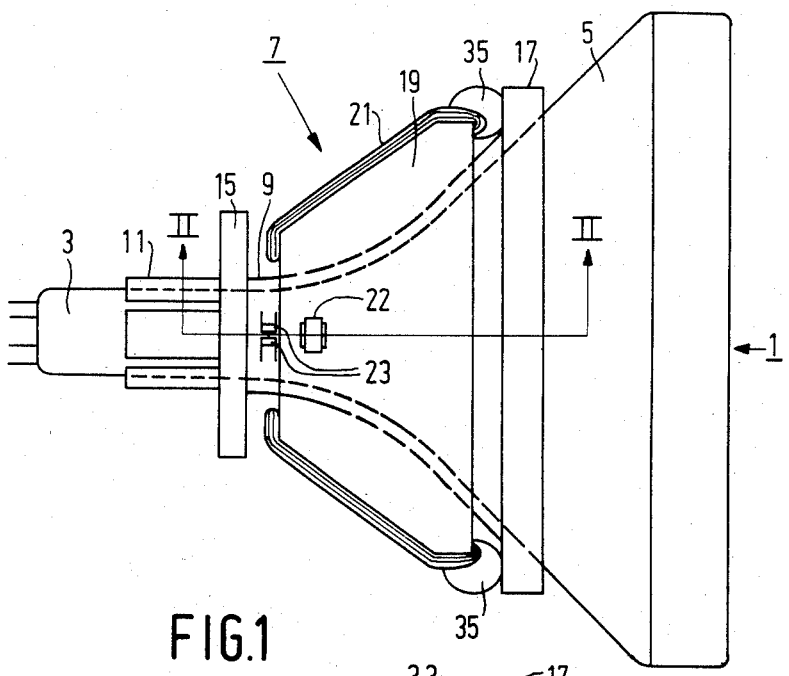

The invention relates to a deflection coil system for a picture display tube comprising a support which is manufactured from an electrically insulating synthetic resin and has a rear portion for fitting around the neck of a picture display tube for which purpose the support has a flaring shape, said support member being surrounded on the outside by an annular ferromagnetic core which supports toroidal deflection coils.

Such a system of deflection coils is known from GB patent specification No. 1,237,005. The annular core is pressed against an abutment in the forward direction so as to fix the axial position of the core. For that purpose, synthetic resin wedges are clamped between the core and a flange formed on the rear side of the support. The provision of said wedges is time-consuming and expensive and it is the object of the invention to provide a deflection coil system in which the core is pushed forward axially without separate auxiliary means and is also centered with respect to the axis of the support.

For that purpose, a deflection coil system according to the invention is characterized in that a number of outwardly directed resilient members extending substantially perpedicularly to the axis of the support are formed on the support adjacent the rear portion therefor which members, on their sides directed towards the front portion of the support, each have a face which is inclined with respect to the said axis and engages the rear side of the core, in such manner that the members centre the core with respect to the said axis by exerting radially outwardly directed forces on said core whilst in addition the core against an abutment on the front portion of the support by exerting axially forwardly directed forces on the core.

A preferred embodiment of the deflection coil system according to the invention is characterized in that the core is permanently connected to the support by means of a glued joint. The resilient members in this case need exert their centring and urging function only until the glued joint has been produced. When after some time the resilient properties deteriorate, as is often the case with synthetic resins, the position of the core does not change thereby.

Figure 2:
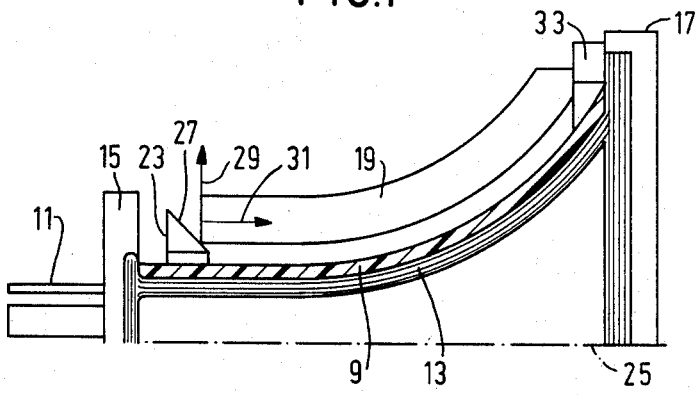
Figure 3:
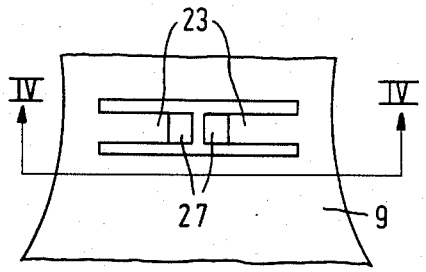
Figure 4:
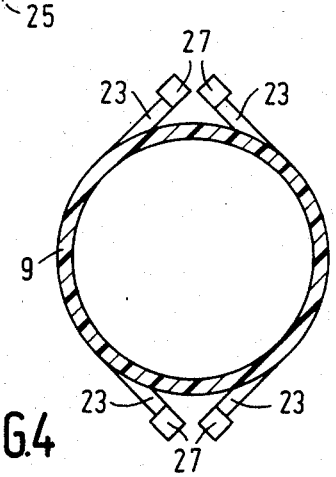

The invention will now be described in greater detail with reference to the drawing. In the drawing:

FIG. 1 is a side elevation of a picture display tube comprising an example of a deflection coil system according to the invention, FIG. 2 is a longitudinal sectional view of the deflection coil system shown in FIG. 1 without the display tube, FIG. 3 is a side elevation of a detail of the deflection coil system, and FIG. 4 is a cross-sectional view taken on the line IV—IV of FIG. 3.

FIG. 1 shows diagrammatically a television display tube 1 having a cylindrical neck 3 and a flared portion 5. At the area of the transition between the two parts a deflection coil system 7 is present around the display tube. The deflection coil system comprises a support 9 which is manufactured from an electrically insulating synthetic resin and which has a cylindrical rear portion 11 which fits around the neck 3 and has integral flexible members which can be clamped around the neck by means of a clamping band (not shown) so as to connect the support rigidly to the display tube. The support 9 is flared so that it is adapted to the shape of the display tube 1. A pair of saddle-shaped deflection coils 13 for the horizontal deflection are provided on the inside of the support 9 (see FIG. 2). Said deflection coils hence are located between the support 9 and the wall of the display tube 1. The coil heads of the saddle-shaped deflection coils 13 are present in hollow spaces which are recessed in flanges 15, 17 formed integral with the support 9. In the rear flange 15 the connection members for the deflection coils and optionally further components may also be accommodated (not shown). On the outside the support 9 is surrounded by an annular ferromagnetic core 19 having a pair of toroidal deflection coils 21 for the vertical deflection. As usual the core 19 consists of two half rings of ferrite which are clamped together by resilient clamping members 22.

At the area of the cylindrical rear portion 11 of the support 9 resilient members 23 are formed in front of the rear flange 15 and extend approximately perpendicularly to the axis 25 of the support and are obliquely directed outwards. In FIGS. 2–4 said members are shown on an enlarged scale. On their sides directed forwards (in FIG. 2 to the right) they comprise a face 27 which is at an angle of approximately 45° with respect to the axis 25 of the support 9. The members 23 form part of the support 9. In the embodiment shown four members 23 are present. The inclined face 27 of each member 23 engages the rear side of the core 19, namely the inner edge thereof. The members 23 are slightly urged inwardly by the core 19 from their rest position. Due to the inclined position of the faces 27 each member 23 exerts a radially outwardly directed force 29 and an axially forwardly directed force 31 on the core 19. The radially outwardly directed forces 29 ensure that the core 19 is centered during assembly with respect to the axis 25, and the axially forwardly directed forces 31 urge the core against abutment members 33 present on the front of the supporting member 9, for example, on the rear side of the front flange 17.

Due to the members 23 the core 19 is accurately held in the desired position both axially and radially without the use of separate components. The synthetic resin from which the support 9 and the members 23 are manufactured, however, in the case of long-lasting loads, tends to show creepage phenomena especially at higher temperatures which often occur in television receivers. As a result of this, in the long run, the members 23 may no longer hold the core 19 rigidly in the correct position. In order to prevent the core 19 from moving after some time, it is permanently connected to the support 9, after assembly, preferably by means of a glued joint. For that purpose, a few drops of adhesive 35 may be provided between the front of the core 19 and the rear side of the flange 17. If desired, a few drops of adhesive may also be provided on the rear side of the core 19 (not shown).

What is claimed is:

1. A deflection coil system for a picture display tube comprising a support which is manufactured from an electrically insulating synthetic resin and has a rear portion for fitting around the neck of a picture display tube for which purpose the support has a flared shape, said support being surrounded on the outside by an annular ferromagnetic core which supports toroidal deflection coils, characterized in that a number of outwardly directed resilient members extending substantially perpendicularly to the axis of the support are formed on the support adjacent the rear portion thereof which members, on their sides directed towards the front portion of the support, each have a face which is inclined with respect to the said axis and engage the rear side of the core in such manner that the members centre the core with respect to the said axis by the exertion or radially outwardly directed forces on said core whilst in addition urge the core against an abutment on the front portion of the support by the exertion of axially forwardly directed forces on the core.

2. A deflection coil system as claimed in claim 1, characterized in that the core is connected permanently to the support by means of a glued joint.

3. Apparatus for positioning an annular core having a rear surface in a deflection coil system for a video display tube having a neck constituting a rear portion and a flaring portion extending forwardly from said neck, said apparatus comprising:

a supporting member having an axis, a rear and forward section respectively surrounding said neck and said flaring portion of said video display tube, an abutment on said forward section, and a plurality of outwardly-directly resilient lugs extending approximately perpendicularly to said axis formed on said rear section, said lugs having a forwardly-directed side including a face inclined with respect to said axis and engaging said rear surface of said core so that said lugs exert radially outwardly directed forces for centering said core with respect to said axis and forwardly directed forces urging said core against said abutment.

4. Apparatus as claimed in claim 3, further comprising a glued joint between said supporting member and said core.

* * * * *

UNITED STATES PATENT AND TRADEMARK OFFICE

CERTIFICATE OF CORRECTION

PATENT NO. : 4,612,524

DATED : September 16, 1986

INVENTOR(S) : ADRIAAN J. GROOTHOFF

It is certified that error appears in the above-identified patent and that said Letters Patent is hereby corrected as shown below:

Column 3, line 7, change "or" to --of--

Signed and Sealed this

Eighth Day of September, 1987

*Attest:*

DONALD J. QUIGG

*Attesting Officer*

*Commissioner of Patents and Trademarks*